United States Patent [19]

Cardiff

[11] Patent Number: 4,534,279

[45] Date of Patent: Aug. 13, 1985

[54] AIR DIRECTING APPARATUS

[76] Inventor: Raymond S. Cardiff, 40 Carnaby St., Macgregor, 4109 Queensland, Australia

[21] Appl. No.: 544,899

[22] Filed: Oct. 24, 1983

[30] Foreign Application Priority Data

Oct. 22, 1982 [AU] Australia ..... PF6476

[51] Int. Cl.[3] ..... F24F 13/16

[52] U.S. Cl. ..... 98/40.18; 98/121.2

[58] Field of Search ..... 98/40 D, 40 V, 94 AC, 98/110, 121 A

[56] References Cited

FOREIGN PATENT DOCUMENTS 133744 10/1979 Japan ..... 98/40 V 165439 12/1980 Japan ..... 98/40 V

*Primary Examiner*—Harold Joyce

*Attorney, Agent, or Firm*—Sughrue, Mion, Zinn, Macpeak & Seas

[57] ABSTRACT

A louvre assembly is provided with a plurality of moveable louvre blades which may be moved between a closed position and an opened air deflecting position. The blades are continuously oscillated while in the opened position to deflect the air passing therethrough in different directions.

5 Claims, 8 Drawing Figures

AIR DIRECTING APPARATUS

This invention relates to improvements in and relating to air outlet assemblies and to methods of distributing air.

Conventional air distribution systems in buildings provide fixed outlet grills through which air is forced into the rooms thereof. The air may be conditioned or unconditioned. In some installations it has been possible to selectively adjust the outlet grill so as to direct the stream of air entering the room to a particular location. This may be for example to a position where the stream of cold air normally required to condition a room will not impinge upon an operator in the room.

In a room utilizing such fixed air circulating means, the air circulation is substantially constant and thus a person or persons in the room are cooled by the effect of the low temperature within the room. As a result in order to provide pleasant working conditions in air conditioned buildings, it is necessary to reduce the temperature within the building to an artifically low temperature. While this method is effective in use, it is expensive to operate.

Also many systems supply unconditioned air to working areas to improve the working conditions. Such systems may be effective in maintaining fresh air circulation in the working area but they do not necessarily create a cooler or more pleasant working environment. Similar comments apply in relation to heating of work areas in cold temperature areas.

This invention aims to provide methods of distributing air and to air outlet assemblies, which will alleviate the abovementioned disadvantages and which will provide reliable and effective in use. Other objects and advantages of this invention will hereinafter become apparent.

With the foregoing and other objects in view, this invention in one aspect resides broadly in an outlet assembly for air supply means, said outlet assembly including air deflector means positionable to deflect air from said air supply means and drive means operable to move said deflector means whereby air may be deflected in different directions.

Preferably, the deflector means is a louvre assembly and said drive means is operable to oscillate the blades of the louvre assembly. The drive means could be in the form of a solenoid actuator or a linear actuator or the like and adapted to pivot the louvre blades at selected time intervals between alternate positions. Alternatively, hydraulic or pneumatic actuators could be arranged to selectively move suitable air deflecting means between predetermined alternate positions so as to deflect air to one side of a room and then to the other side of the room. Preferably however, the drive means is operable to continuously move said deflector means.

It is also preferred that there be provided closure means for moving the movable air deflector blades to a closed position when the air supply is inoperative. The closure means could be manually operated, but preferably the closure means is associated with the air supply means so as to be actuated therewith to move the deflector blade or blades from a closed position to an operative position and to close the deflector blade or blades upon shut down of the air supply. For this purpose the drive means could be a pneumatically controlled oscillator operable to oscillate the blades about an open position or to move the blades to or from the closed position. Preferably however the drive means is an electric motor which is continuously operable to oscillate the blades and said closure means is operable to position said electric motor in a first position to move the blades to an open position or in a second position to hold the blades shut.

In another aspect, this invention resides broadly in an air supply assembly including air supply means, air outlet means associated therewith, said air outlet means including a plurality of air deflector blades positionable to deflect air from said air supply means and drive means operable to oscillate said blades to cause air flow therefrom to vary in direction.

In yet a further aspect, this invention resides broadly in a method of distributing air to selected space, the method including introducing an air flow to said space through an air outlet assembly including a variable air deflector assembly and varying said air deflector assembly to cause air flow therefrom to vary in direction.

Preferably the air flow is conditioned air from air conditioning apparatus, but of course it could be ambient air or recirculated air.

In order that the invention may be more readily understood and put into practical effect, reference will now be made to the accompanying drawings which illustrate a typical embodiment made in accordance with one aspect of the invention and wherein.

Figure 1:
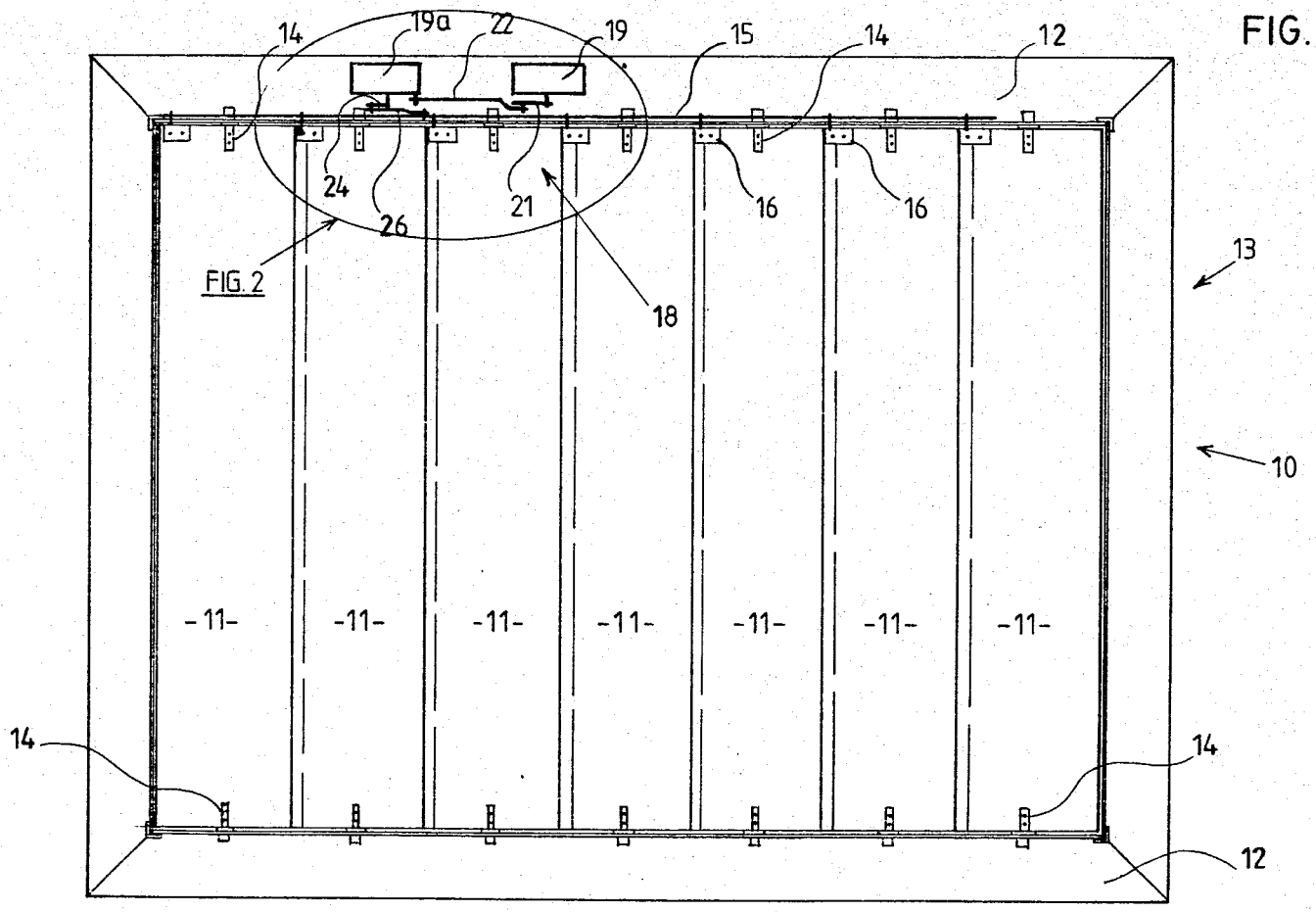
FIG. 1 is a plan view of a louvre type air outlet assembly.
Figure 2:
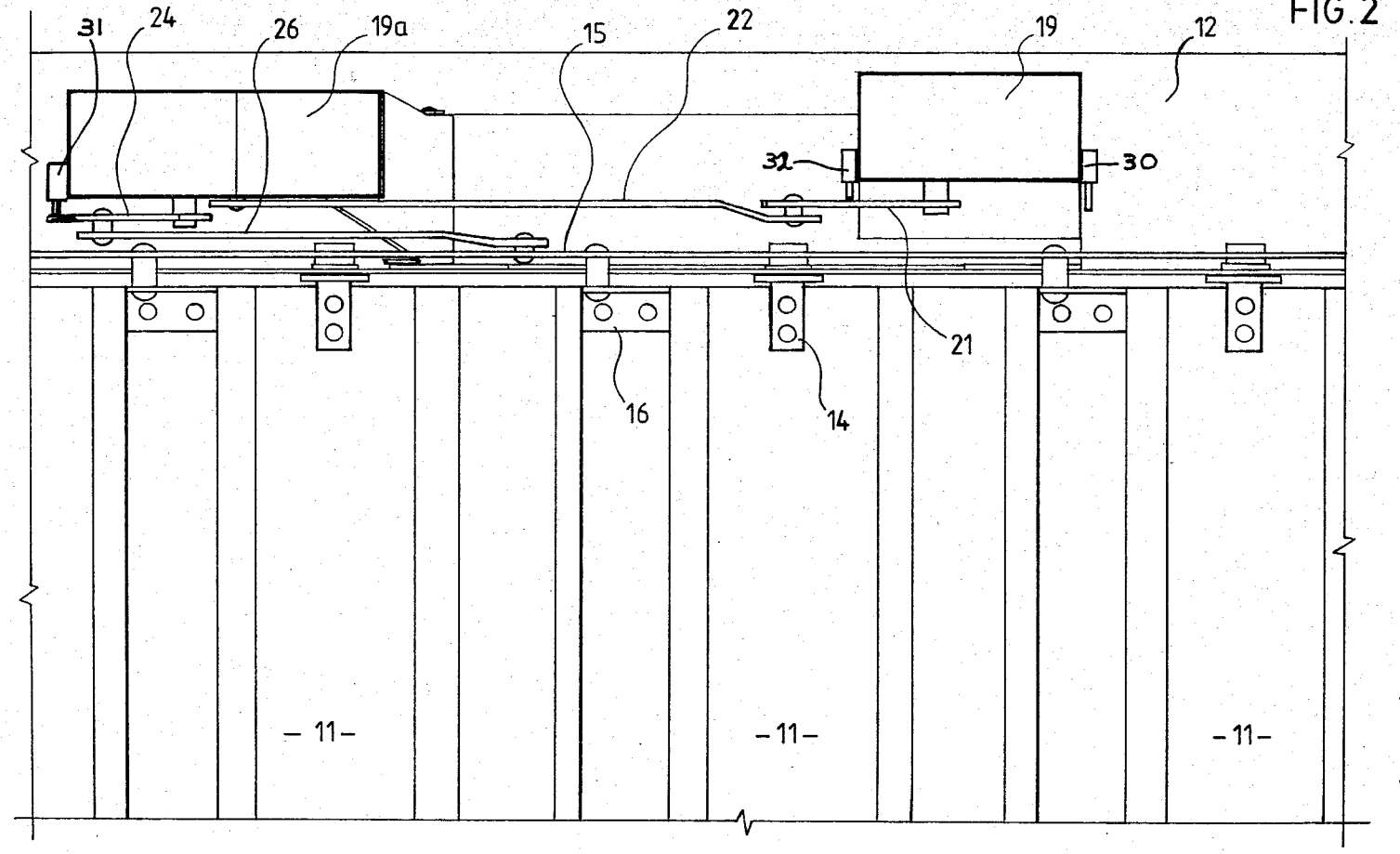
FIG. 2 is an enlarged plan view of the driving assembly therefor.

Referring to FIG. 1, it will be seen that there is provided a louvre type outlet assembly 10 which may be used to provide a variable air supply to a space such as a room from an air supply conduit or the like. The assembly 10 includes a plurality of louvre blades 11 supported pivotally between side frame 12 of a perimeter frame assembly 13 for pivotal movement about respective centrally disposed stub axle assemblies 14. The louvre blades 11 are pivotable from a closed position, as shown in FIG. 1, at which they effectively close the outlet assembly 10, to an open position at which the blades are arranged in spaced parallel relationship to permit air flow there-between.

Figure 3:
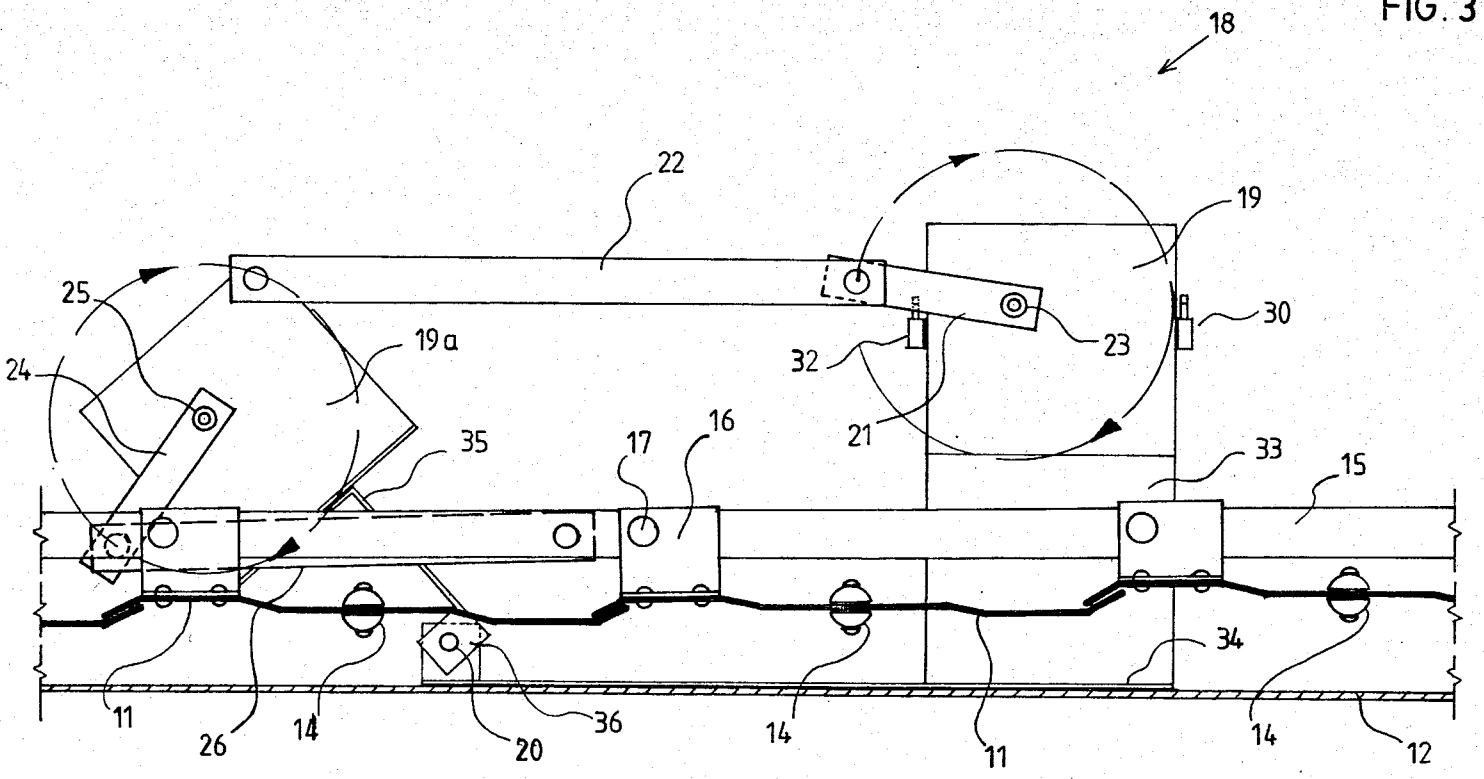
FIG. 3 is an enlarged side view of the driving assembly and illustrating the louvre blades in their closed attitude.
Figure 4:
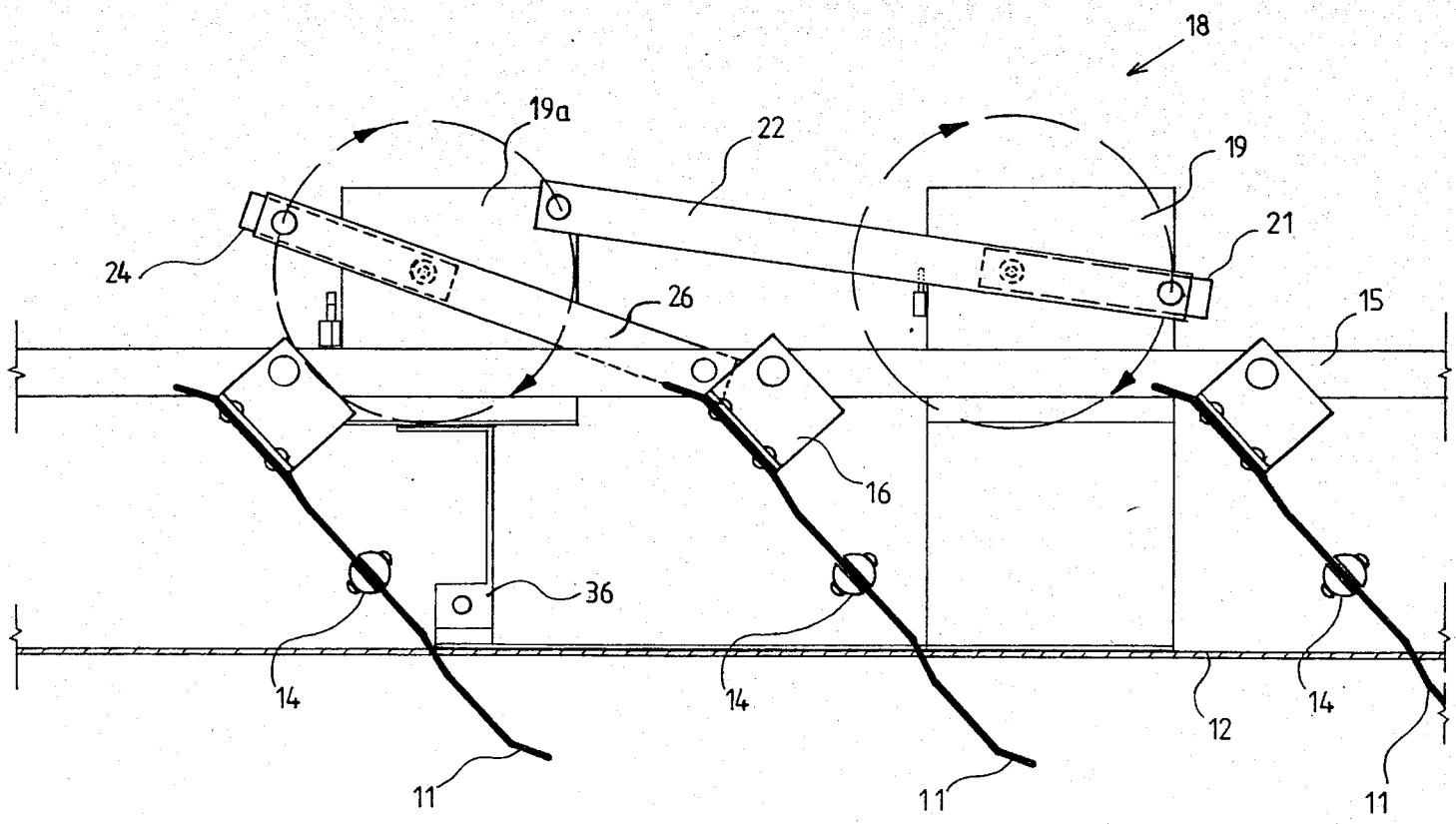
FIGS. 4 and 5 are views corresponding to FIG. 3 showing the driving assembly and the louvre blades in opposed operative attitudes.
Figure 5:
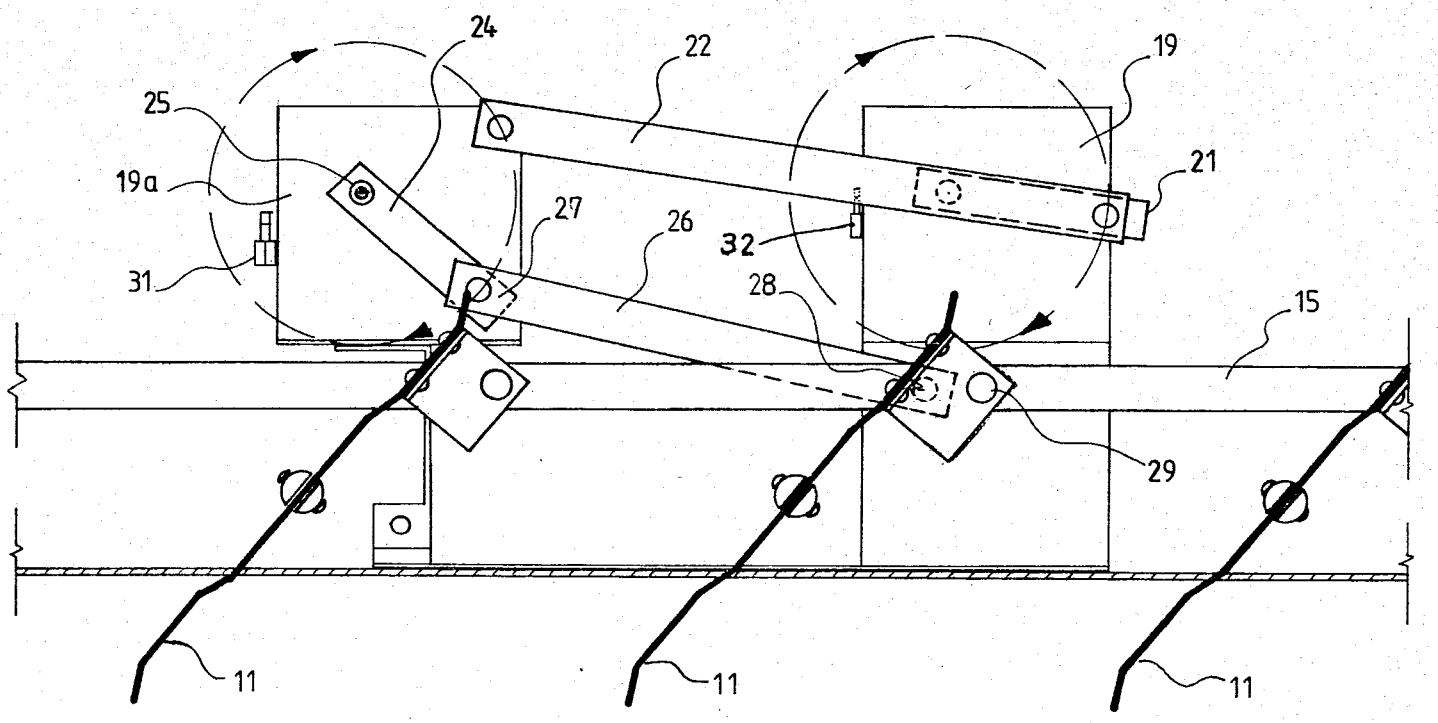

As shown in FIGS. 3 to 5, the blades 11 are each pivotally interconnected at one end to a common operating bar 15 through a right angle bracket member 16 secured to a respective edge portion of each louvre blade 11. These brackets 16 are apertured to enable a fastener to pass therethrough and through a corresponding one of a plurality of spaced apertures in the operating bar 15 to form the pivotal connection between the blade 11 and the operating bar 15. Suitable these connections are formed by snap-together fasteners inserted in opposite directions through the respective apertures.

A louvre blade operating assembly 18 is supported on one side frame 12. This assembly 18 co-operates with the operating bar 15 so as to move it longitudinally and reciprocably to oscillate the louvre blades 11. The assembly 18 includes a pair of motors 19 and 19*a* which may be identical if desired. The actuating motor 19 is supported fixedly on a bracket 33 secured to the side frame 12 while the other, the driving motor 19*a*, is supported on a bracket 35 which is connected pivotally at 20 to the side frame 12. The output shaft of the actuating motor assembly 19 supports a crank arm 21 which is pivotally interconnected with the motor 19*a* through a connecting link 22. The latter is connected at one end to the outer end of the crank arm 21 and at its other end to the driving motor 19*a*. The arrangement is such that as the drive shaft 23 rotates through 360°, the crank shaft 21 will, during its first half revolution, pivot the driving motor 19*a* from an inoperative position, as shown in FIG. 3, to an operative position as shown in FIGS. 4 and 5, while the second half revolution of the crank arm 21 will return the driving motor 19*a* back to its inoperative position.

A crank arm 24 is supported on the output shaft 25 of the driving motor 19*a* and this crank shaft 24 is connected to the operating bar 15 through a linkage 26. One end 27 of the linkage 26 is pivotally connected to the crank shaft 24 while the opposite end 28 is pivotally connected to the operating bar 15 at a position spaced from the adjacent pivotal connection 29 between the respective louvre blade 11 and the operating bar 15. When the driving motor 19*a* is disposed in the operative position as shown, it will be readily apparent that as the crank arm 24 rotates with the crank shaft 25, the louvre blades 11 will oscillate between oppositely disposed open positions, as illustrated, so that air forced through the outlet assembly 10 will be continuously varied in direction so as to be directed alternately to opposite sides of the outlet assembly 10.

Each motor assembly 19 and 19*a* is provided with respective limit switches which monitor selected positions of the crank shafts 21 and 24. The limit switches control the operation of the motors 19 and 19*a* for remote actuation of the assembly. The switching arrangement is such that upon remote switching of a master switch (not shown), the actuating motor 19 commences to rotate the crank arm 21 in the direction indicated for one-half revolution until the crank arm 21 contacts the micro-switch 30. Contact with this switch 30 will cause the supply of electricity to the motor 19 to be cut off and transferred to the motor 19*a*. This half revolution of the crank shaft 21 pivots the driving motor 19*a* from its inoperative position to its operative position. At the same time, the operating bar 15 will be lifted with the driving motor 19*a* to a position at which the louvre blades will be disposed in an open position and actuation of the motor 19*a* will cause the blades to be oscillated between their extreme opposite position as illustrated in FIGS. 4 and 5.

When the master switch is switched off, the crank arm 24 will continue to rotate until it contacts the micro-switch 31 which will stop the supply of electricity to the operating motor assembly 19*a* and cause connection of the supply to the actuating motor 19. This will cause the crank arm 21 to rotate through a further one-half revolution during which it will pivot the operating motor 19 to the inoperative position causing the louvre blades 11 to move to their closed position. A third micro-switch 32 is provided on the actuating motor 19 to cut the supply of power to the actuating motor 19 at the positive corresponding to the closed position of the louvre blades. Thus the blades, upon shutdown by the master switch, will always return to their closed position.

Figure 8:
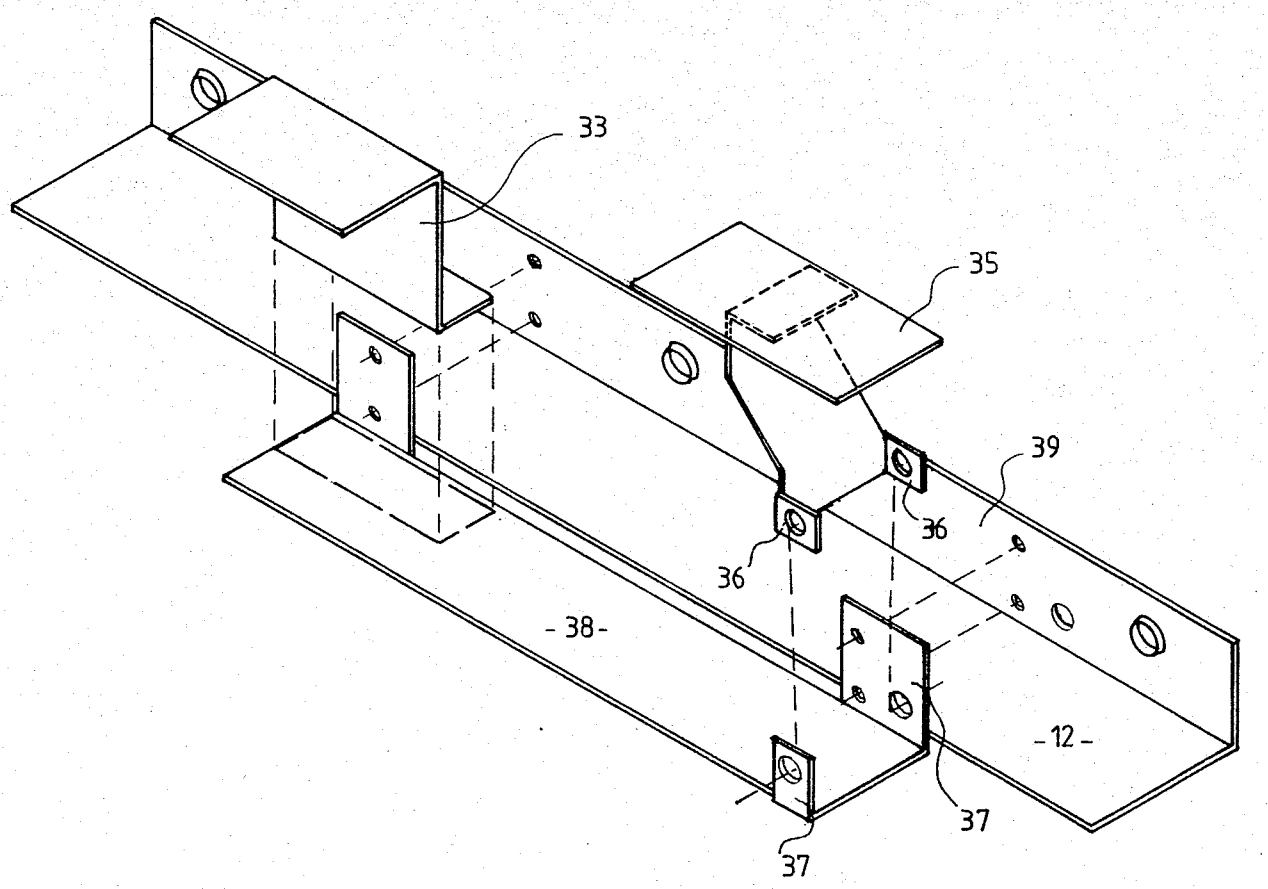
FIG. 8 is a perspective view of the mounting components of the driving assembly.

Preferably the actuating motor 19 is supported on a z-shaped bracket 33 fixed at its base 34 to a removable cradle 38 while the driving motor 19*a* is supported on the pivot mounting 35 which is provided with spaced apertured lugs 36 connected between corresponding apertured upstanding lugs 37 provided on the cradle 38. The latter is adapted to be bolted to the side flange 39 of the side frame 12 so that the assembly can be detached as a complete unit including the motors 19 and 19*a*, the micro-switches and the operating cranks. This construction will be made clear with reference to FIG. 8.

Figure 7:
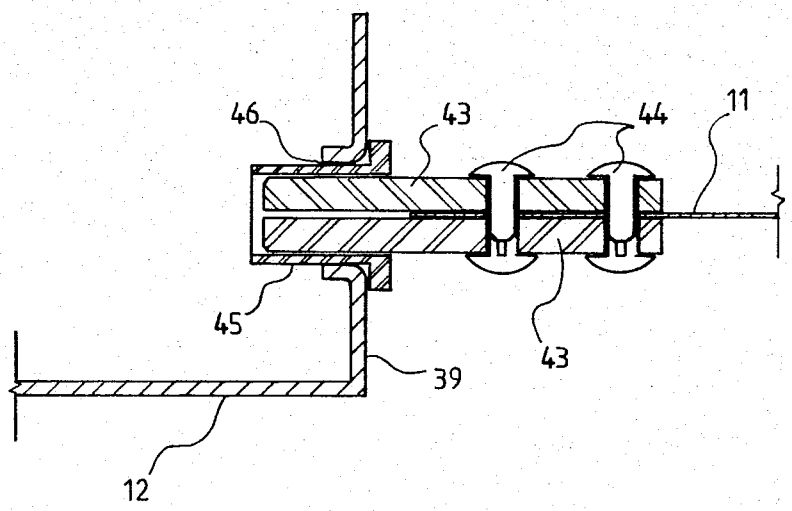
FIG. 7 illustrates one form of pivotal connection between the louvre blades and the supporting frame.
Figure 6:
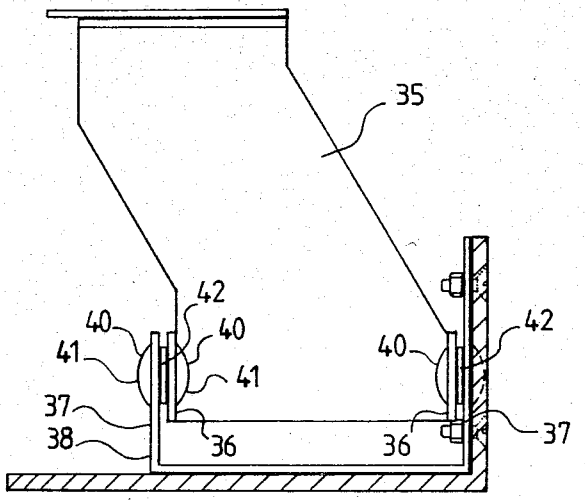
FIG. 6 is an end view of the pivotal motor mounting components.

As shown in FIG. 6, the pivot mounting 35 is connected to the cradle 38 by means of snap-together plastic fasteners 40 which include a pair of identical members each having a rounded head portion 41 and spaced shanks having inner serrated faces which interlock with the corresponding shanks of an identical fastener to form a substantial cylindrical body portion extending between the heads 41 of the two fasteners. A teflon washer 42 or the like is interposed between the lugs 36–37 to reduce friction. This type of snap-together fastener is preferably used throughout the construction of the apparatus for many of the pivotal connections so that servicing will be simplified. Furthermore, with reference to FIG. 7, it will be seen that each louvre blade 11 is pivotally connected to the side flange 39 of the side frame 12 by a demountable connection including a pair of semi-cylindrical axle members 43 adapted to be pinned together by snap connectors 44 which pass therethrough and through corresponding apertures in the louvre blades 11. The axle members 43 are preferably formed of a plastics material and are supported in a bush 45 which is pressed into an aperture 46 formed in the side flange 39 by through punching to form a shouldered bore as illustrated. This type of connection has the advantage that blades 11 can be easily replaced in situ since the stub axle components 43 may be withdrawn through the bush 46 in either direction after removing the snap connectors 44.

From the above it will be seen that the preferred embodiment of the invention provides air flow control means which will be simple to fabricate since the number of different components required for assembly is relatively small by virtue of the use of the snap-together connectors for forming the pivotal connections and by utilizing an identical actuating motor assembly and operating motor.

In an alternate embodiment of this invention there is provided an actuating motor assembly provided with a crank arm operatively connected to the operating bar of a louvre assembly to move same between open and closed positions. The motor may be provided with control means to hold the louvre blades in either selected position or if desired, it may be continually operated. Alternatively worm drive screw means or the like could be incorporated to be actuated upon start-up and switch-off to cause the louvre blades 11 to move between their closed attitudes and operative position.

In use, the outlet assembly 10 may be utilized in the ceiling or wall of a room such that air flow therefrom will vary in direction and persons in the room will experience intermittent flow of air which causes a chill effect possibly by evaporation on the persons exposed skin such that a person in the room will feel comfortable even though the ambient temperature is not as low as would be required in a normal air conditioned room. Thus the outlet assembly 10 may be used to direct conditioned air into a room with the benefit that the temperature of the conditioned air can be elevated above normally acceptable air conditioned temperatures with a consequent saving in operating costs.

It will of course be realised that while the above has been given by way of illustrated example of the invention, all such modifications and variations thereto as would be apparent to persons skilled in the art and deemed to fall within the broad scope and embodiment of the present invention as is defined in the appended claims.

I claim:

1. An outlet assembly for an air supply means including air deflector means comprising a louvre assembly having a plurality of louvre blades positionable to deflect air from the air supply means; selectively operable closure means for moving the blades between a closed and an open air deflecting position; and, drive means operable to oscillate the blades about the open position.

2. An outlet assembly according to claim 1, wherein said louvre blades are connected to a common actuating member, said member being operatively connected to said drive means, the drive means being movable from an operative position to an inoperative position to cause said blades to move to said closed position.

3. An outlet assembly according to claim 2, including actuating means for moving said drive means between said operative and inoperative positions.

4. An outlet assembly according to claim 3 whereby upon commencement of air supply to said outlet assembly, said actuation means moves said drive means from said inoperative position to said operative position and said drive means is activated.

5. An outlet assembly according to claim 4, wherein said drive means and said actuating means each include a crank-shaft and a reciprocable linkage associated therewith and said control means includes sensing means for detecting selected positions of said crank shafts.

* * * * *